US006568147B1

(12) United States Patent
Sumner, Sr.

(10) Patent No.: US 6,568,147 B1
(45) Date of Patent: May 27, 2003

(54) METHOD AND SYSTEM FOR EMPLACING MOBILE AND MODULAR CONSTRUCTIONS

(76) Inventor: John Eugene Sumner, Sr., 2107 Pleasant Ridge Rd., Greensboro, NC (US) 27410

( * ) Notice: Subject to any disclaimer, the term of this patent is extended or adjusted under 35 U.S.C. 154(b) by 0 days.

(21) Appl. No.: 09/710,778

(22) Filed: Nov. 9, 2000

(51) Int. Cl.[7] ..... E02D 5/74; E02D 5/76; E02D 13/08

(52) U.S. Cl. ..... 52/745.12; 52/741.14; 52/741.15; 52/169.9; 52/DIG. 11; 52/170

(58) Field of Search ..... 52/169.9, 169.12, 52/169.13, 170, 292, 296, 297, 294, 299, 721.1, DIG. 3, DIG. 2, DIG. 11, 745.12, 741.14, 741.15

(56) References Cited

U.S. PATENT DOCUMENTS

| | | | | | |
|---|---|---|---|---|---|
| 2,138,958 | A | * | 12/1938 | Corbett et al. | 52/169.9 |
| 3,282,001 | A | * | 11/1966 | Bigalow | 52/169.9 |
| 3,664,082 | A | | 5/1972 | Zintel | 52/742 |
| 3,789,559 | A | * | 2/1974 | Kirkes | 52/169 |
| 3,830,024 | A | | 8/1974 | Warnke | 52/23 |
| 3,831,329 | A | * | 8/1974 | Lear | 52/126 |
| 4,010,584 | A | | 3/1977 | Barnes, Jr. | |
| 4,064,668 | A | | 12/1977 | Carter | |
| 4,125,975 | A | * | 11/1978 | Soble | 52/126 |
| 4,229,919 | A | * | 10/1980 | Hughes | 52/263 |
| 4,348,843 | A | | 9/1982 | Cairns et al. | |
| 4,404,780 | A | | 9/1983 | Josephson | |
| 4,570,409 | A | * | 2/1986 | Wilks | 52/742 |
| 4,738,061 | A | | 4/1988 | Herndon | |
| 4,761,924 | A | | 8/1988 | Gustafson | |
| 4,866,797 | A | | 9/1989 | Vollan | |
| 4,870,789 | A | | 10/1989 | Clark et al. | 52/126.6 |
| 4,882,887 | A | | 11/1989 | Giles et al. | 52/126.6 |
| 4,914,875 | A | | 4/1990 | Gustafson | |
| 4,937,989 | A | * | 7/1990 | Miyares et al. | 52/126.7 |
| 4,976,077 | A | * | 12/1990 | Tucker | 52/126.6 |
| 5,152,108 | A | * | 10/1992 | Madl, Jr. | 52/126.1 |
| 5,224,311 | A | | 7/1993 | Pearce | |
| 5,363,610 | A | * | 11/1994 | Thomas et al. | 52/167 |
| 5,509,237 | A | * | 4/1996 | Coulter | 52/126.6 |
| 5,515,655 | A | | 5/1996 | Hoffmann | |
| 5,595,366 | A | | 1/1997 | Cusimano et al. | |
| 5,697,191 | A | | 12/1997 | MacKarvich | |
| 5,701,715 | A | | 12/1997 | Masters et al. | |
| 5,784,844 | A | * | 7/1998 | Mackarvich | 52/292 |
| 5,797,226 | A | | 8/1998 | MacKarvich | |
| 5,850,718 | A | | 12/1998 | MacKarvich | |
| 5,862,635 | A | | 1/1999 | Linse et al. | |
| 6,058,663 | A | | 5/2000 | MacKarvich | |

FOREIGN PATENT DOCUMENTS

| | | | | |
|---|---|---|---|---|
| JP | 3813 | * | 1/1995 | 52/169.9 |
| JP | 197478 | * | 8/1995 | 52/169.9 |
| JP | 159141 | * | 6/2001 | 52/169.13 |
| JP | 336147 | * | 12/2001 | 52/169.12 |

* cited by examiner

*Primary Examiner*—Lanna Mai
*Assistant Examiner*—Phi Dieu Tran A
(74) *Attorney, Agent, or Firm*—Womble Carlyle Sandridge & Rice, PLLC

(57) ABSTRACT

A system and method for emplacing a mobile or modular construction of the type having a supporting structure provided thereunder including multiple stanchions having upper and lower portions, fasteners for attaching each of the upper portions of the stanchions to the supporting structure of the mobile or modular construction, and load-bearing footings embedding the lower portions of the stanchions, wherein the embedded stanchions provide permanent vertical support for the mobile or modular construction.

3 Claims, 3 Drawing Sheets

METHOD AND SYSTEM FOR EMPLACING MOBILE AND MODULAR CONSTRUCTIONS

FIELD OF THE INVENTION

The present invention relates to a method and system for positioning and supporting mobile or modular constructions. More particularly, the invention relates to a structural foundation system including multiple supporting stanchions, or support piers, permanently embedded in concrete footings.

BACKGROUND OF THE INVENTION

Numerous methods have been used in the past to place or position mobile homes or other modular constructions on a prepared foundation, either temporary or permanent. Traditionally, "mobile" factory-built constructions have been merely placed on blocks, such as stacks of loosely placed concrete blocks. Since such supporting techniques involve no lateral support to resist loads such as wind or earthquake, various types of tie-downs or anchoring systems have been employed over the years.

As evidenced by damage statistics, mobile and modular constructions suffer tremendous damage as a result of the overturning forces of high winds despite the fact that they have been tied down or anchored. Further, even when firmly installed, these conventional systems become loose over time due to repetitive tugging caused by the wind, and thus lose their effectiveness.

There are known in the art numerous more sophisticated support systems that have been conceived to address the above problems. However, these systems are quite expensive and labor intensive in their installation. For example, there are known supporting systems involving screw-jack arrangements, telescoping multi-sectional piers, or a combination of these in conjunction with shim plates for leveling. Additionally, the systems known in the art require elaborate footing schemes that include embedded anchor bolts, base plates, and rods. Despite the complex nature of these systems, properly leveling the mobile or modular constructions is tedious and often impossible since each of the supporting piers must be individually adjusted.

SUMMARY OF THE INVENTION

The present invention relates to a unique foundation system for supporting mobile or modular constructions that is cost effective, easily and accurately installed, and will better withstand the forces of nature. As used herein, "mobile or modular constructions" means structures, in whole or in part, that are pre-manufactured before being moved to the site of installation. Such structures include, but are not limited to, mobile homes, doublewide homes, manufactured housing, and commercial structures such as modular office spaces and classrooms. According to the present invention, the structure is levelly positioned over a prepared footing pattern; rigid support stanchions extend downward from the support frame of the structure into the footings; and footing material such as concrete is poured into each excavation and allowed to harden while the structure is levelly maintained.

The invention is used with mobile or modular constructions of the type having two or more longitudinally extending support frame members thereunder. Once the structure is in position and leveled, the stanchions are attached to the support frame members of the structure at spaced points corresponding to the previously prepared footings. The stanchions are long enough to extend into the footings where footing material, such as concrete, is poured beneath and around each stanchion. The footing material is allowed to harden while the structure is maintained level and in position. The stanchions are desirably formed as generally square tubes of Grade A50 steel, but may be formed of other grades, including, but not limited to, Grade A36.

The order of certain steps of this method is not critical. For example, the mobile or modular construction may be initially moved into position over a plurality of footing excavations wherein stanchions are then attached to the supporting structure of the mobile or modular construction. Alternatively, the stanchions may be attached to the support members prior to moving the mobile or modular construction into position. In either case, the upper portions of the stanchions are attached to the support members of the mobile or modular structure using angles or other suitable fasteners. The mobile or modular construction is positioned over the footing excavations so that the excavations are in substantial alignment with the support members of the mobile or modular structure. When all of the stanchions are attached, each will extend down into one of the footing excavations.

The mobile of modular construction is next leveled in preparation for forming the footings. Alternatively, however, the construction could have been leveled prior to attaching the stanchions. Any of the conventional methods known in the art may be used for satisfactorily leveling the mobile of modular structure. As necessary, the structure must be lowered so that the stanchions extend downward into the footing excavations at least 24 inches. With the stanchions extending into the footing excavations, an unhardened load-bearing material, such as concrete, is poured into the excavated footings, embedding the lower portions of the stanchions in at least about 24 inches of concrete. For rapid curing, concrete additives may be used so that the jacks or other leveling or holding devices may be removed in as little as 24 hours. However, for normal concrete mixtures under ideal conditions, a curing time of approximately 7 days is required. During the curing and hardening period, the mobile of modular structure must be maintained in a level position.

These and other aspects of the present invention will become apparent to those skilled in the art after a reading of the following description of the preferred embodiment when considered with the drawings.

DETAILED DESCRIPTION OF THE PREFERRED EMBODIMENTS

The present invention is directed to foundation system and a method for permanently supporting mobile or modular constructions.

Figure 1:
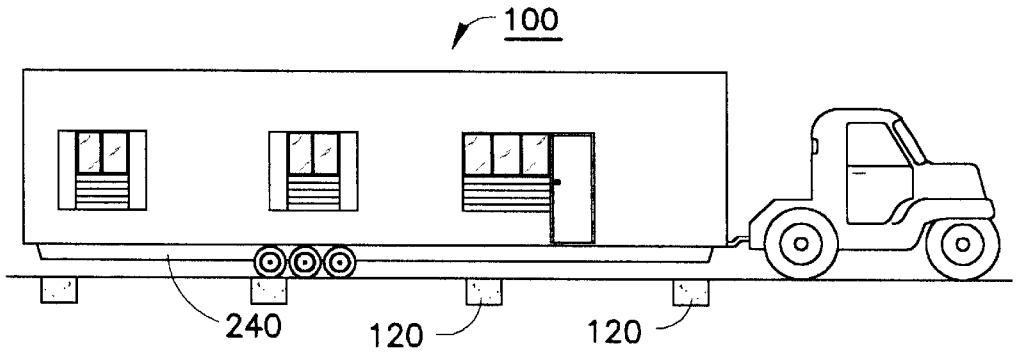
FIG. 1 schematic of a mobile construction being moved into place over prepared excavated footings, FIG. 2 schematic illustrating the general alignment of mobile or modular construction supporters over excavated footings.

As illustrated schematically in FIG. 1, mobile or modular constructions 100, whether for residential or commercial use, are normally pre-manufactured and transported intact to the buyer's property where they are made ready for habitation. At the buyer's location, the mobile or modular construction must be placed upon some form of foundational support, typically involving supporting the construction on level footings with blocks, jacks or the like. The present invention is not intended to change the mode of transporting the construction to its destination, but rather to introduce a superior foundation system and method for emplacing the construction 100 when it arrives at its destination.

Figure 2:
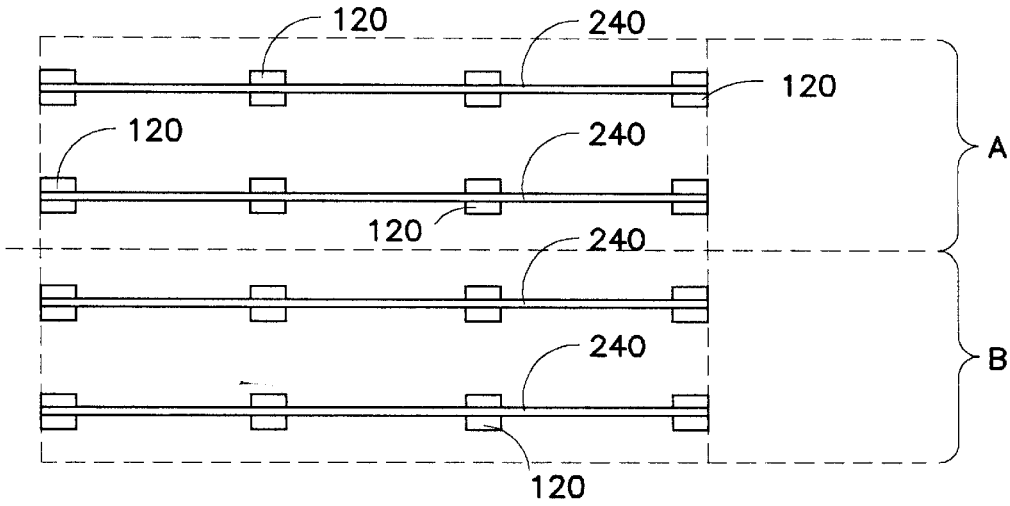

As shown in FIGS. 1 and 2, when a mobile or modular construction 100 is positioned for installation, it is typically oriented so that the underlying support frame members 240 of the construction are generally aligned with footings or proposed footings 120. FIG. 2 is schematically illustrative of the support arrangement for a doublewide type construction where the construction consists of for two sections A and B that are mated together at the installation site. Each section A and B normally has two support frame members 240 provided thereunder. Support members used in the industry are generally I-beams; however, tubular support members and box-like beams are also known. Thus, for a doublewide construction, there are usually four support members 240. A conventional mobile home, on the other hand, would be represented by either A or B with two underlying support members 240. As also shown in FIG. 2, there are typically four spaced footings 120 for each support member 240.

Figure 3:
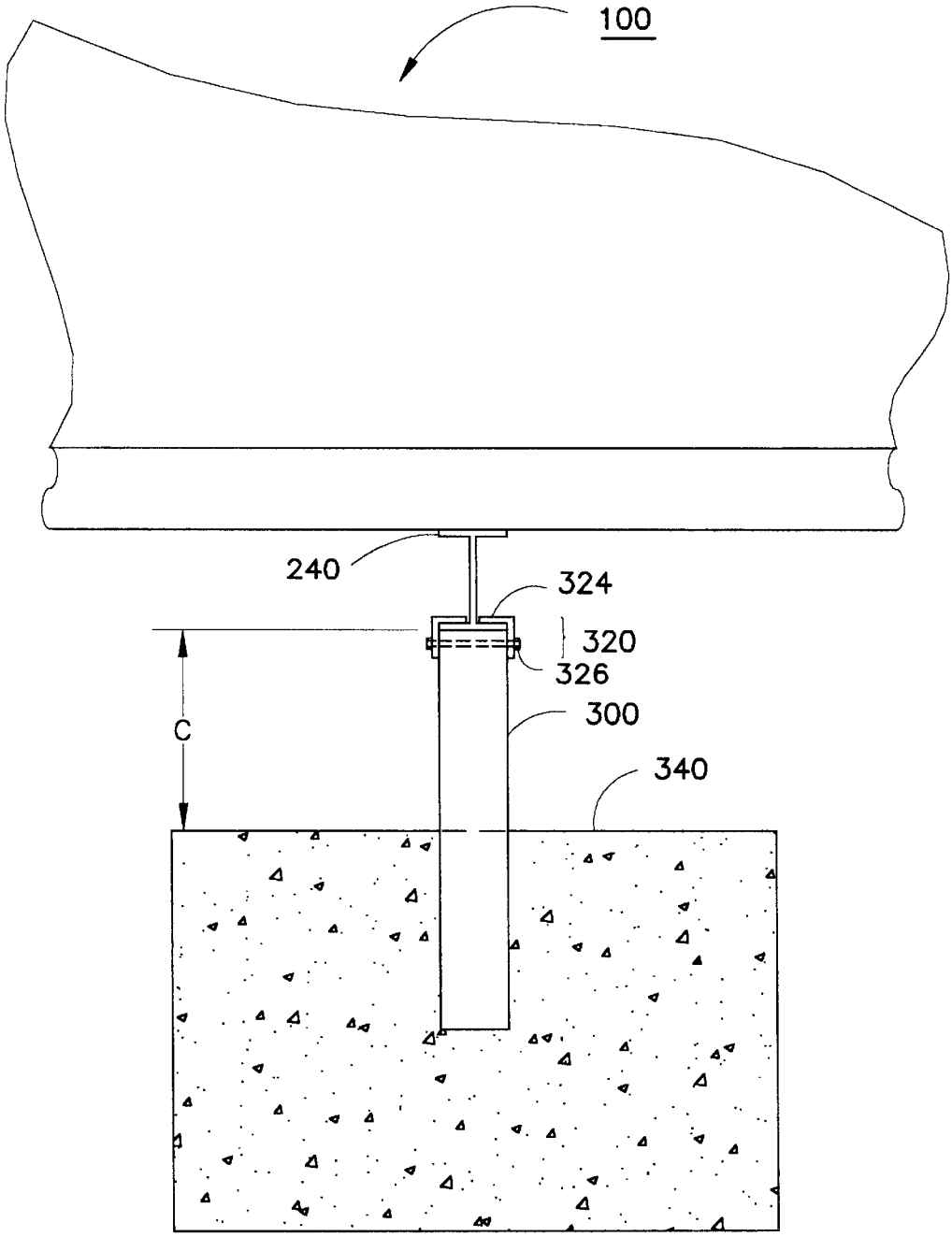
FIG. 3 is a side sectional view of the support system of the present invention.
Figure 4:
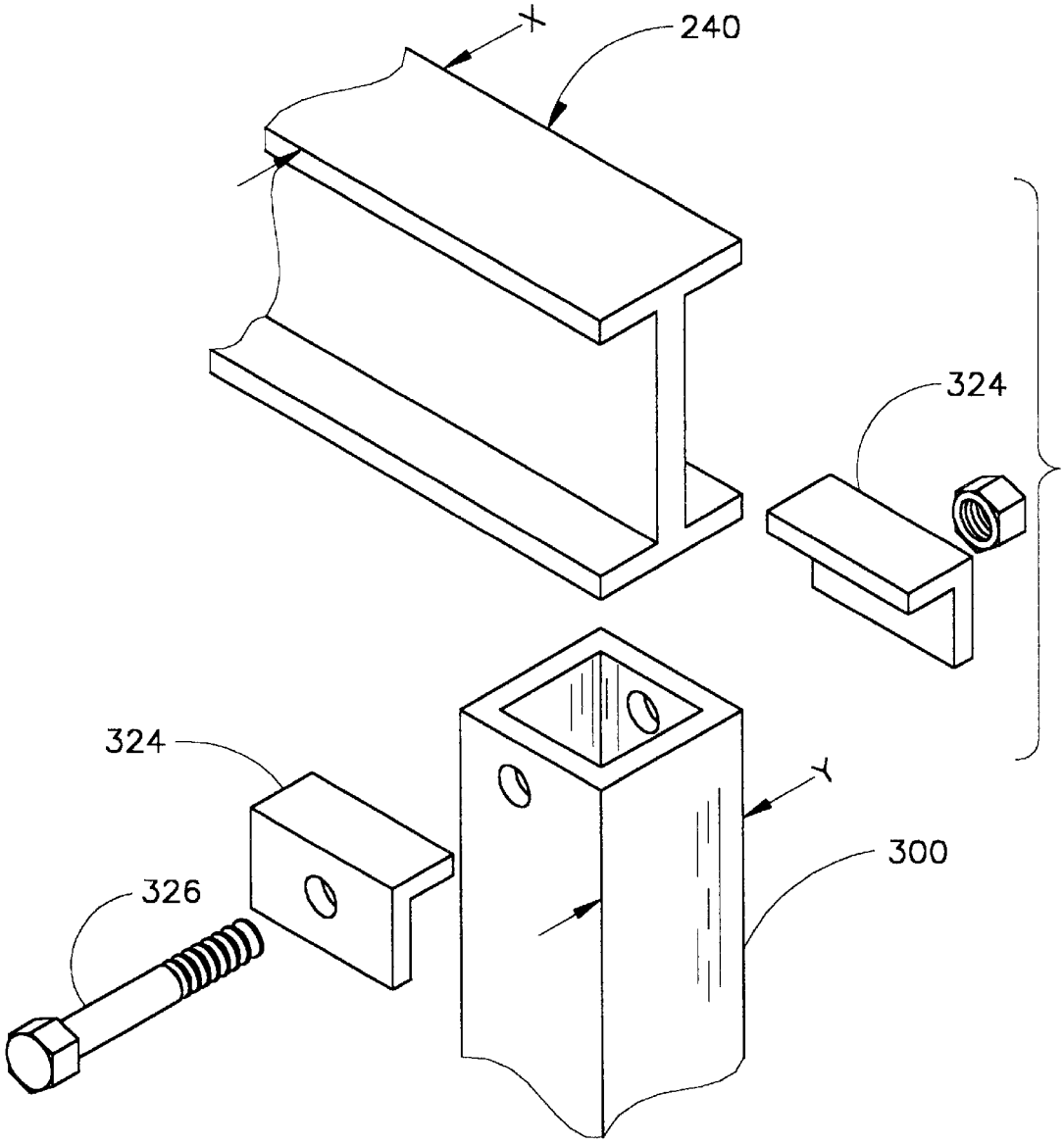
FIG. 4 exploded view of the support system of the present invention.

One aspect of the present invention is to provide a system for supporting mobile or modular constructions 100 as described hereinabove. As shown in FIGS. 3 and 4, the foundation system of the present invention comprises stanchions 300, fastening assemblies 320, and embedded footings 340.

Stanchions, or piers, 300 are formed as a single piece from Grade A50 tubular steel stock. The stanchions may be transported separately, or could be hingedly attached to supports 240, so that upon positioning, they could be rotated into position and rigidly secured. Dependent upon the contour of the ground, stanchions 300 may vary in length up to a maximum clear height. As used herein, "maximum clear height" refers to the vertical distance between the bottom of support member 240 and the top of footing 340, as permitted by local building codes. While Grade A50 steel is preferred, lesser grades, down to and including Grade A36 are also suitable for the present invention. Likewise, structurally equivalent shapes other than square tubes may be used; however, suitable tubular steel is well known and conventional. The cross section of the stanchions 300 chosen for the foundation system is governed by the flange width (x) of the support member 240 (I-beam). For a support member flange with a width (x) of 3 inches, a square tube with a 3×3×¼ cross-section is used. For a flange width (x) of 4 inches, a 4×4×3/16 inch tube is used. Thus, preferably the side width (y) of stanchion 300 will equal the flange width (x) of support member 240.

Since stanchions 300 will typically be cut from square tube stock, the upper end of the tubes should be squarely cut to ensure uniform and continuous contact between stanchions 300 and support 240.

As illustrated in FIGS. 3 and 4, fasteners 320 are provided for connecting the upper portion of stanchion 300 to support members 240. Fasteners 320 comprise a pair of right angles 324 and bolt 326. While the fasteners illustrated in FIGS. 3 and 4 are used for connecting the present invention to conventional I-beam support members 240, other conventional fasteners known in the art for connecting structural steel will be used for tubular or box beam type support members. For I-beams with 4-inch flanges, L 1¾×2×¼ inch right angles are used, and for 3-inch flanges, L 1¼×2×¼ inch right angles are used. As will be appreciated by those skilled in the art, the horizontal and vertical dimensions of the right angles are not critical and, as such, a range of sizes may be suitably used. Likewise, where I-beams are used with smaller or greater flange widths than those described herein, the sizes of the fasteners used will of necessity vary. Angles 324 are formed from at least Grade A36 steel. For I-beam arrangements such as that shown in FIGS. 3 and 4, an angle 324 is placed on either side of stanchion 300 so that each angle overlaps one side of the flange of the I-beam 240. Bolt 326 is inserted through holes or slots formed through the stanchion 300 and angles 324 to securely connect stanchion 300 to support member 240.

Load bearing footings 340 are used to embed the lower portions of stanchions 300. In the preferred embodiment, a 4000-psi concrete is used to cast each footing. The footings are preferably 3×3×3 feet horizontally and should embed at least 24 inches of each stanchion 300 to provide adequate structural support.

Another aspect of the present invention is to provide a method for positioning and supporting a mobile or modular construction 100 using the system described hereinabove.

The order of certain steps of the method described herein is not critical to the satisfactory accomplishment of emplacing a mobile or modular construction 100. Specifically, and again referring to FIGS. 1 and 2, the mobile or modular construction 100 may be initially moved into position over footing excavations 120 wherein stanchions 300 are then attached to supporting members 240 of the mobile or modular construction 100. Alternatively, stanchions 300 may be attached to support members 240 prior to moving the construction 100 to its destination. In the latter case, stanchions 300 are configured so that they are stored in a position amenable to transport. In either case, the upper portions of stanchions 300 are attached to the support members 240 using fasteners 320 described hereinabove and the construction 100 is positioned over footing excavations 120 such that the stanchions 300 are vertically oriented over excavations 120.

The construction 100 is leveled in preparation for forming the footings 340. Alternatively, however, constructions 100 can be leveled prior to attaching the plurality of stanchions 300. Any of the conventional methods and devices known in the art may be used for performing this step. As necessary, construction 100 must be lowered or positioned so that the stanchions 300 extend at least 24 inches into excavations 120.

With constructions 100 level and the lower portions of stanchions 300 extending into excavations 120, a mixture of 4000 psi concrete is poured into the excavations 20 to embed stanchions 300 and form footings 340. During the curing and hardening period that ensues, the mobile or modular construction 100 must be maintained in a level position. For typical concrete mixtures, a curing time of approximately 7 days is required. However, for rapid curing, concrete additives may be used so that the jacks or other holding devices may be removed in as little as 24 hours. As will be appreciated by those skilled in the art, the cure time for concrete is dependent upon a number of factors including ambient temperature, humidity, etc. Following removal of the leveling and holding devices, a permanent foundation is established.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

I claim:

1. A method for emplacing a mobile or modular construction having support frame members provided thereunder over a pattern of footing excavations, comprising:

(a) moving a mobile or modular construction in position over the pattern of footing excavations, wherein the footing excavations are positioned substantially in alignment with the support frame members;

(b) attaching stanchions to spaced points along the support frame members, each of the stanchions being substantially vertically oriented over and extending into one of the footing excavations, the lower load bearing ends of each of the stanchions being spaced from the bottom of the footing excavations;

(c) leveling the mobile or modular construction;

(d) placing an unhardened load-bearing material in the plurality of footing excavations around and under the stanchions; and (e) maintaining the construction level wherein upon hardening, the lower load bearing ends of the stanchions are embedded in and supported by the load-bearing material.

2. A method for emplacing a mobile or modular construction having a supporting structure provided thereunder over a pattern of footing excavations, comprising:

(a) attaching stanchions to spaced points along the supporting structure, the stanchions being substantially vertically oriented and corresponding to the pattern of footing excavations;

(b) moving a mobile or modular construction in position over the pattern of footing excavations, wherein the stanchions are positioned substantially in alignment over the footing excavations;

(c) leveling the mobile or modular construction;

(d) placing an unhardened load-bearing material in the footing excavations around and under the stanchions; and (e) maintaining the construction level, wherein upon hardening, the lower load bearing ends of the stanchions are embedded in and supported by the load-bearing material.

3. A method for emplacing a mobile or modular construction having support frame members provided thereunder over a pattern of footing excavations, comprising:

(a) attaching stanchions to spaced points along the support frame members;

(b) positioning and leveling the mobile or modular construction over the pattern of footing excavations, wherein each of the stanchions are substantially vertically oriented over and extending into one of the footing excavations, the lower load bearing ends of the stanchions being spaced from the bottom of the footing excavations;

(c) placing an unhardened load-bearing material in the plurality of footing excavations around and under the stanchions; and (d) maintaining the construction level wherein upon hardening, the lower load bearing ends of the stanchions are embedded in and supported by the load-bearing material.

* * * * *